US006722238B2

(12) United States Patent
Shinga

(10) Patent No.: US 6,722,238 B2
(45) Date of Patent: Apr. 20, 2004

(54) METHOD AND DEVICE FOR FEEDING AND CUTTING A ROLLED TRANSFER PAPER WITH IMPROVED OPERABILITY

(75) Inventor: Takahiro Shinga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 09/838,313

(22) Filed: Apr. 20, 2001

(65) Prior Publication Data

US 2002/0000144 A1 Jan. 3, 2002

(30) Foreign Application Priority Data

Apr. 21, 2000 (JP) ..... 2000-120888
Mar. 14, 2001 (JP) ..... 2000-071893

(51) Int. Cl.[7] ..... B26D 5/20

(52) U.S. Cl. ..... 83/63; 83/76.7; 83/76.9; 83/369; 83/649; 83/949; 399/385; 399/393

(58) Field of Search ..... 83/72, 76.8, 76.9, 83/76.6, 352–354, 364, 365, 367, 369, 370, 373, 614, 649, 62, 63, 949, 202, 210, 208; 242/564.4; 399/384, 393, 16, 18, 385; 400/621; 101/224, 226, 227; 358/498, 304; 355/41, 75

(56) References Cited

U.S. PATENT DOCUMENTS 3,550,490 A * 12/1970 Hicks ..... 82/48
3,559,519 A * 2/1971 Westphal ..... 83/210
3,564,960 A * 2/1971 Edwin ..... 83/203
3,817,134 A * 6/1974 Katayama et al. ..... 83/203
3,843,253 A * 10/1974 Mikan et al. ..... 355/29
4,699,034 A * 10/1987 Sue ..... 83/649
4,949,607 A * 8/1990 Yuito ..... 83/76.7
4,969,016 A * 11/1990 Kudoh ..... 399/18
5,131,302 A * 7/1992 Watanabe ..... 83/62
5,134,915 A * 8/1992 Fukano et al. ..... 83/563
5,172,238 A * 12/1992 Kuboki ..... 358/296
5,375,494 A * 12/1994 Kajita et al. ..... 83/210
5,579,099 A * 11/1996 Nishiyama et al. ..... 399/371
5,690,009 A * 11/1997 Nakao et al. ..... 83/76.8
5,745,832 A * 4/1998 Yoshiuchi ..... 399/384
5,765,092 A * 6/1998 Yoshiuchi et al. ..... 399/394
5,860,344 A * 1/1999 Yamamoto et al. ..... 83/365
6,091,928 A * 7/2000 Fuchisawa ..... 399/384
6,386,080 B1 * 5/2002 Okamoto et al. ..... 83/73

FOREIGN PATENT DOCUMENTS

JP 2522675 12/1991
JP 6-234446 8/1994
JP 7-115784 12/1995

* cited by examiner

*Primary Examiner*—Boyer D. Ashley
(74) *Attorney, Agent, or Firm*—Oblon, Spivak, McClelland, Maier & Neustadt, P.C.

(57) ABSTRACT

A paper feeding device and method, wherein a tray including a paper loading unit, a paper feeding device, a paper cutting device is slid out of a main body of an image forming apparatus. When a new rolled transfer paper is loaded in the paper loading unit, the rolled transfer paper is conveyed so that a tip portion thereof is discharged from a rolled transfer paper outlet of the tray. The discharged tip portion of the rolled transfer paper is cut by the paper cutting device.

24 Claims, 5 Drawing Sheets

METHOD AND DEVICE FOR FEEDING AND CUTTING A ROLLED TRANSFER PAPER WITH IMPROVED OPERABILITY

BACKGROUND OF THE INVENTION

1. Field of the Invention

The present invention relates to a paper feeding device to be used in an image forming apparatus, such as a copying machine, a printer, and a facsimile, etc., and more particularly to the paper feeding device that improves an operability in feeding and cutting a tip portion of a rolled transfer paper.

2. Discussion of the Background

In an image forming apparatus, such as a copying machine, a printer, and a facsimile, an image is transferred onto a plain paper, etc., as an image output. As an output medium, a rolled transfer paper is available in addition to a sheet transfer paper.

In the image forming apparatus in which a rolled transfer paper is used, a tray accommodating the rolled transfer paper is slid out of the image forming apparatus to replace with a new rolled transfer paper and cut a tip portion thereof, when the rolled transfer paper has been consumed, or when the rolled transfer paper is dirty or damp.

A leading edge of the rolled transfer paper is often uneven and/or slanted. An operation is then required to make the leading edge of the transfer paper even and non-slanted so that the rolled transfer paper is smoothly conveyed and is cut into a regular size.

Conventionally, in order to eliminate an uneven and/or a slanting leading edge, an operator cuts a tip portion of the rolled transfer paper while the tray accommodating the rolled transfer paper is slid out of the image forming apparatus or the tip portion of the rolled transfer paper is cut by a built-in cutter after sliding the tray accommodating the new rolled transfer paper into the image forming apparatus and feeding the tip portion thereof by an appropriate length.

For cutting the tip portion of the rolled transfer paper while the tray accommodating the rolled transfer paper is slid out of the image forming apparatus, an operator manually reels out the rolled transfer paper. This operation may not be difficult when the rolled transfer paper is small in size. To the contrary, when a rolled transfer paper of a large size, such as A-1 or A-0 is reeled out and a tip portion thereof is cut by the operator, an amount of work performed by the operator is increased.

When mechanically cutting a tip portion of a rolled transfer paper by a cutter provided in the image forming apparatus, the tip portion of the rolled transfer paper is reeled out by a motor. However, when the tip portion is cut at a shorter length from its leading edge, the rolled transfer paper may jam if the cut out tip portion is conveyed into a paper conveying path inside a main body of the image forming apparatus.

SUMMARY OF THE INVENTION

The present invention has been made in view of the above-mentioned and other problems and addresses the above-discussed and other problems.

The present invention advantageously provides a novel paper feeding device to be used in an image forming apparatus wherein a reel-out operation of a tip portion of a rolled transfer paper and a cutting operation of the reeled out tip portion are easily performed. The paper feeding device is configured such that the rolled transfer paper is fed and a tip portion of the rolled transfer paper is cut automatically, when a tray accommodating the rolled transfer paper is slid out of the image forming apparatus and a new rolled transfer paper is loaded. However, the tip portion of the rolled transfer paper is cut only when a discharged length of the tip portion from a rolled transfer paper discharging outlet of the tray is more than a predetermined length so that an operator can grasp the cut out tip portion of the rolled transfer paper with fingers and remove it. Thereby the cut out tip portion of the rolled transfer paper is not conveyed into a paper conveying path of an image forming apparatus, which avoids an improper conveyance of the rolled transfer paper caused by a jamming of the cut out tip portion of the rolled transfer paper.

According to an embodiment of the present invention, a paper feeding device includes a tray, accommodating a rolled transfer paper therein, which is configured to be slid out of a main body of the image forming apparatus when replacing the old rolled transfer paper with a new rolled transfer paper. The tray includes a paper loading unit to load a rolled transfer paper therein, a paper feeding device to feed the rolled transfer paper, and a paper cutting device to cut a tip portion of the rolled transfer paper fed by the paper feeding device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 4, 4A and 4B are flow charts illustrating a procedure for an operation of the paper feeding unit;

DETAILED DESCRIPTION OF THE PREFERRED EMBODIMENTS

Figure 1:
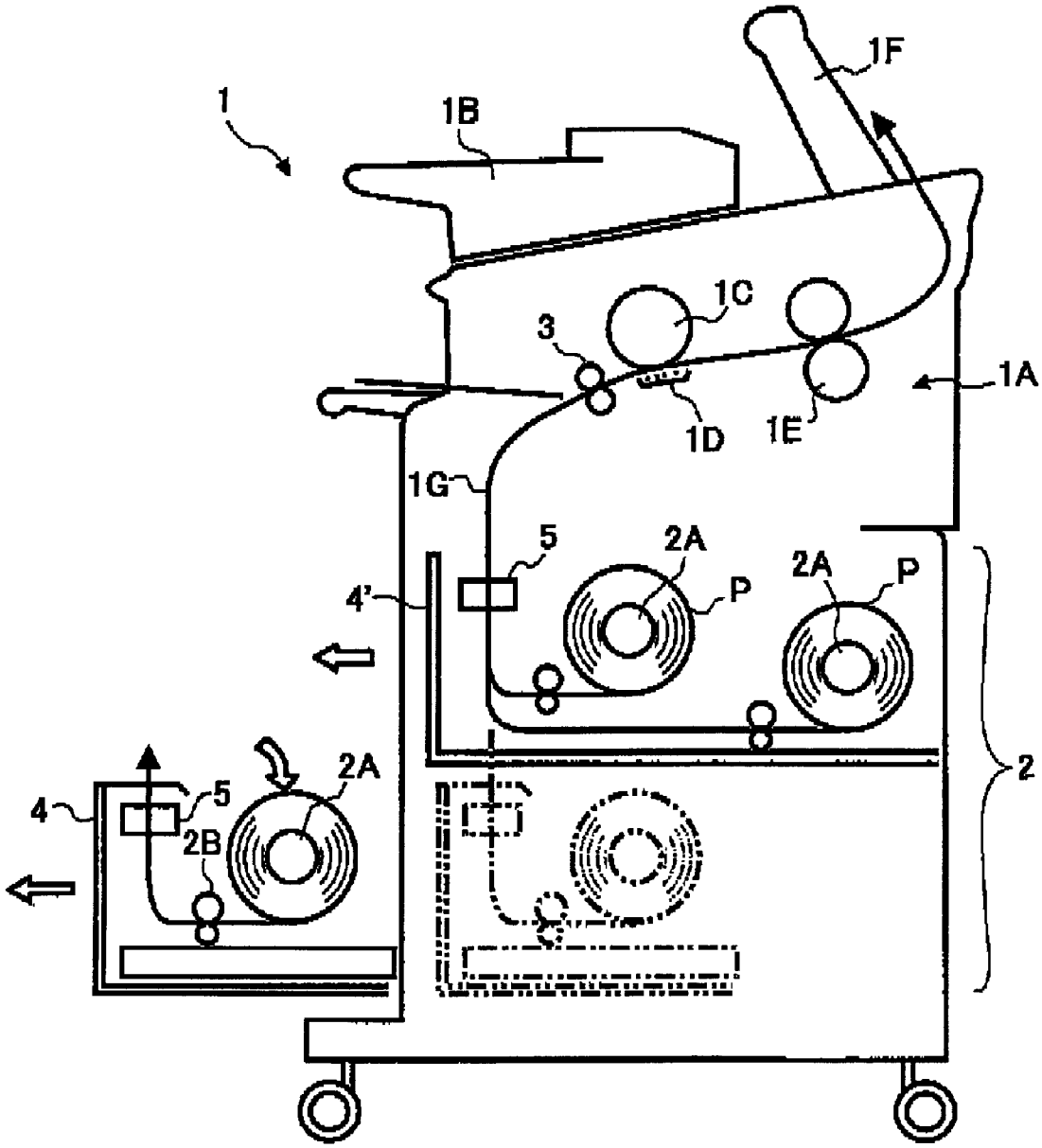
FIG. 1 is a schematic drawing illustrating an exemplary construction of a copying machine as an example of an image forming apparatus in which a paper feeding unit according to an embodiment of the present invention is used.

Referring now to the drawings, wherein like reference numerals designate identical or corresponding parts throughout the several views, FIG. 1 is a schematic drawing illustrating a copying machine as an example of an image forming apparatus in which a paper feeding unit according to an embodiment of the present invention is used. A copying machine 1 in FIG. 1 includes an image forming section 1A, an original document reading section 1B, and a paper feeding unit 2. According to an embodiment of the present invention, the paper feeding unit 2 is configured to use a rolled transfer paper P. The image forming section 1A includes a photoconductive element 1C as an image bearing member, a charging unit (not shown), a writing unit (not shown), a developing unit (not shown), an image transfer unit 1D, and a fixing unit 1E. These units perform image forming processes. A registration roller 3 adjusts a time to feed the rolled transfer paper P to a transfer position of the photoconductive element 1C.

A toner image formed on the photoconductive element 1C is transferred on the transfer paper P. The transferred toner image is fixed onto the transfer paper P by the fixing unit 1E. The transfer paper P is then discharged to an exit tray 1F. The original document reading section 1B has a well-known original document scanning structure which also serves as a writing section to write an image on a surface of the photoconductive element 1C.

The paper feeding unit 2 includes a tray 4 which can be slid out/into a main body of the copying machine 1. According to an embodiment of the present invention, two trays are vertically arranged (an upper tray is described with a reference numeral of 4').

The trays 4 and 4' include a rolled transfer paper loading unit 2A, a paper feeding roller 2B (see FIGS. 2 and 3), and a paper cutting unit 5 which include a cutter. The rolled transfer paper loading unit 2A can contain a rolled transfer paper of multiple sizes.

Figure 3:
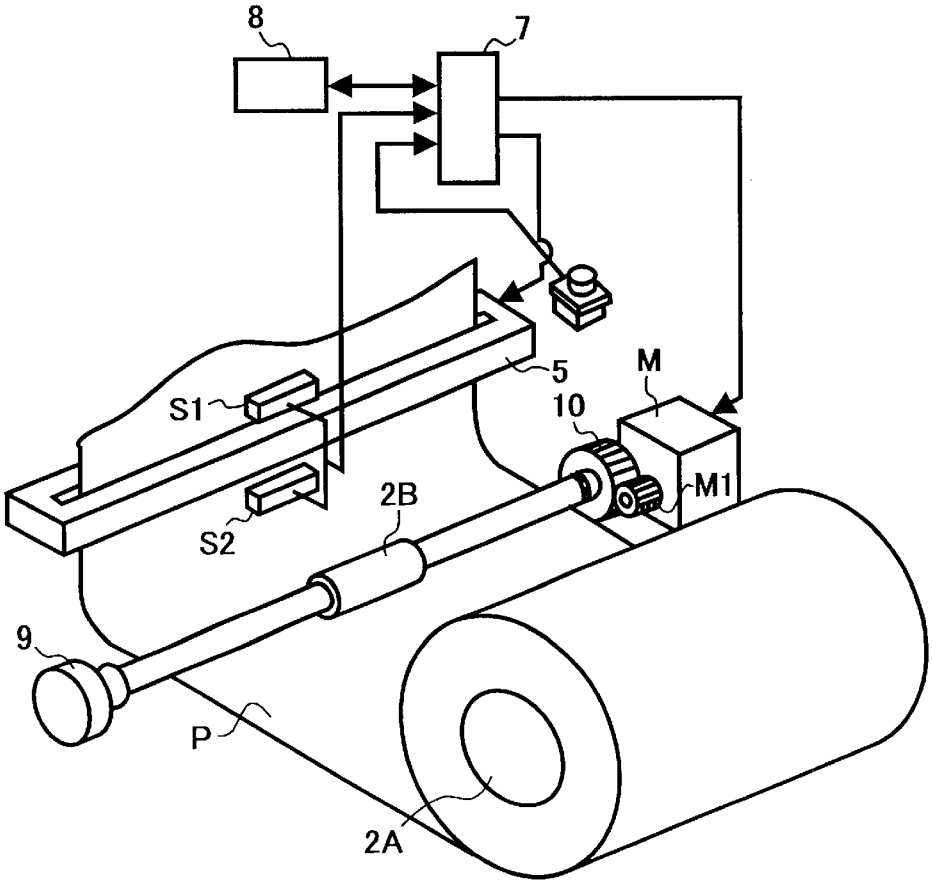
FIG. 3 is a block diagram illustrating a relationship between each component illustrated in FIG. 2 and a control section.

The paper feeding roller 2B conveys the rolled transfer paper P by sandwiching it. As illustrated in FIG. 3, a driven gear 10 is provided at one axial end of a spindle of the paper feeding roller 2B. The driven gear 10 is engaged with a driving gear M1 of a driving motor M to rotate the paper feeding roller 2B so as to feed the rolled transfer paper P. A knob 9 is provided at the other axial end of the spindle of the paper feeding roller 2B. The knob 9 can be rotated by an operator.

The paper feeding unit 2 includes a paper automatic feeding switch 6, and optical sensors S1 and S2. The paper automatic feeding switch 6 activates a rotation of the paper feeding roller 2B while the optical sensors S1 and S2 detect a movement of the rolled transfer paper P.

According to an embodiment of the present invention, the driving motor M starts rotating when the paper automatic feeding switch 6 is depressed (i.e., the switch is turned on). The driving motor M keeps on rotating while the paper automatic feeding switch 6 is kept depressed. When the paper automatic feeding switch 6 is released (i.e., the switch is turned off), the paper cutting unit 5 starts cutting a tip portion of the rolled transfer paper P under a stipulated condition which is explained below.

Figure 2:
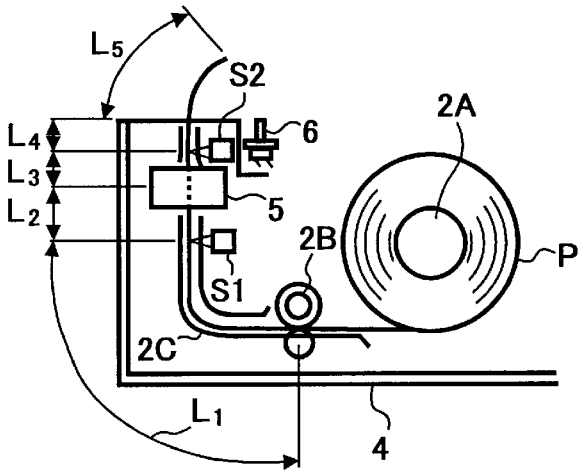
FIG. 2 is a schematic drawing illustrating an exemplary construction of the paper feeding unit in FIG. 1

Reflective sensors having light emitting and receiving elements are used as optical sensors S1 and S2. At least one optical sensor is provided in a rolled transfer paper conveying path through which the rolled transfer paper is conveyed from the paper feeding roller 2B to a paper conveying path inside the main body of the image forming apparatus. According to an embodiment of the present invention, two optical sensors (i.e., S1 and S2) are employed. As illustrated in FIG. 2, the optical sensor S1 is disposed between the paper feeding roller 2B and a cutting position of the paper cutting unit 5. The optical sensor S2 is disposed between the cutting position of the paper cutting unit 5 and a rolled transfer paper discharging outlet of the tray 4 where a tip portion of the rolled transfer paper P is discharged from the tray 4.

In FIG. 2, a guide plate 2C is provided between the paper feeding roller 2B and the paper cutting unit 5 to guide a conveyance of the rolled transfer paper P. The guide plate 2C is configured to direct the rolled transfer paper P 90° upward so that the rolled transfer paper P is conveyed to a paper conveying path 1G provided inside the copying machine 1.

According to an embodiment of the present invention, a position of a leading edge of the rolled transfer paper P fed by the paper feeding roller 2B is detected. A tip portion of the rolled transfer paper P is then cut based on the detection result. Control over a paper cutting operation is explained below.

Relative distances among the optical sensors S1 and S2, the paper feeding roller 2B, and the cutting position of the paper cutting unit 5 are set as described below.

L1: The distance between the paper feeding roller 2B and the optical sensor S1.

L2: The distance between the optical sensor S1 and the paper cutting unit 5.

L3: The distance between the paper cutting unit 5 and the optical sensor S2.

L4: The distance between the optical sensor S2 and the rolled transfer paper discharging outlet of the tray 4. The reference numeral L5 shows a length of the rolled transfer paper P discharged from the rolled transfer paper discharging outlet of the tray 4.

A control section 7, which is described below, judges a conveying situation of the rolled transfer paper P based on the above-described distances. FIG. 3 is a block diagram illustrating a relationship between each component illustrated in FIG. 2 and the control section 7. The control section 7 includes a microcomputer as a main part. The optical sensors S1 and S2, the paper automatic feeding switch 6, and an input section 8 are connected to the control section 7 in an input side via an I/O interface (not shown). The input section 8 includes an operation unit which sets a length of the rolled transfer sheet P to be cut. That is, the operation unit designates a distance between a leading edge of the rolled transfer paper P and a position thereof to be cut. The paper cutting unit 5 and the driving motor M of the paper feeding roller 2B are connected to the control section 7 in an output side via a driving section (not shown).

The control section 7 calculates a conveyed length of the rolled transfer paper P, i.e., a position of a leading edge of the rolled transfer paper P is calculated, from a speed with which the rolled transfer paper P is conveyed by the paper feeding roller 2B, and a time when the optical sensors S1 and S2 detect the leading edge of the rolled transfer paper P. When the paper automatic feeding switch 6 is released, the control section 7 judges whether or not the rolled transfer paper P has been conveyed more than a predetermined length. When the control section 7 judges that the rolled transfer paper P has not been conveyed more than the predetermined length, a tip portion of the rolled transfer paper P is not cut by the paper cutting unit 5. The calculation used for the above-described control is explained below.

(A) A position of a leading edge of the rolled transfer paper P is calculated from a conveying speed of the rolled transfer paper P and a time required for traveling the distance between the two optical sensors S1 and S2. When the time required to travel the distance between the two optical sensors S1 and S2 exceeds a predetermined time period or when the travel of the rolled transfer paper P is not detected, the copying machine 1 gives an alarm to inform an operator of an abnormal conveyance of the rolled transfer paper P.

For example, because the distance between each component and the conveying speed of the rolled transfer paper P are known, a predetermined time period to be compared with a time that the rolled transfer paper P travels the distance between the paper feeding roller 2B and the optical sensor S1 is obtained from the calculated value of dividing L1 by V0 (i.e., L1/V0). V0 is a traveling speed of the rolled transfer paper P.

A predetermined time period to be compared with a time that the rolled transfer paper P travels from the paper feeding roller 2B to the optical sensor S2 is obtained based on the above mentioned principle, i.e., from the calculated value of dividing the added values of L1, L2, and L3 by the traveling speed of the rolled transfer paper P. That is (L1+L2+L3)/V0. These so obtained values are recorded in the control section 7 as the predetermined time period. A time period actually required for traveling a distance is input to the control section 7 so that the input time period is compared with the recorded time period for the corresponding distance.

(B) A paper cutting operation is performed based on the premise that a leading edge of the rolled transfer paper P has passed through the paper cutting unit 5. However, it is important that the leading edge of the rolled transfer paper P has sufficiently been conveyed such that a tip portion of the rolled transfer paper P can be grasped with the fingers of an operator. The control section 7 detects a position of the leading edge of the rolled transfer paper P and judges whether or not the leading edge of the rolled transfer paper P has sufficiently been discharged from the rolled transfer paper discharging outlet of the tray 4 such that the tip portion of the rolled transfer paper P can be grasped with the fingers and be removed. A cutting operation of the tip portion of the rolled transfer paper P is not performed when the control section 7 judges that the leading edge of the rolled transfer paper 7 has not sufficiently been conveyed.

A method of detecting a leading edge of the rolled transfer paper P is explained below. A traveled distance of the rolled transfer paper P from the cutting position of the paper cutting unit 5 to the optical sensor S2 is obtained by the below-mentioned calculation formula. That is, add the value, which is calculated by multiplying V0 by a conveyed time period of the rolled transfer paper P after a leading edge thereof is detected by the optical sensor S1, to L3. Namely, (V0× a conveyed time period of the rolled transfer paper P after a leading edge thereof is detected by the optical sensor S1)+L3. (Relational Expression (1))

Only when the below mentioned condition of (2) is satisfied, the paper cutting unit 5 is operated. That is, {(V0× a conveyed time period of the rolled transfer paper P after a leading edge thereof is detected by the optical sensor S2)+L3}−L3−L4>a predetermined length. (Relational Expression (2))

The left edge of the relational expression (2) corresponds to L5 (see FIG. 2) which is a discharged length of the rolled transfer paper P from the rolled transfer paper discharging outlet of the tray 4. This discharged length corresponds to a length of the rolled transfer paper P which an operator can grasp. According to an embodiment of the present invention, this length is set approximately to be 25 mm. A tip portion of a replaced rolled transfer paper P is discharged by depressing the paper automatic feeding switch 6. When the paper automatic feeding switch 6 is released, the discharged tip portion of the rolled transfer paper P is cut only when the discharged length (i.e., L5) is more than the predetermined length.

The control section 7 controls the paper cutting unit 5 so as not to perform a paper cutting operation when the above-described relational expression (2) is not satisfied. An alarm device is employed to give an alarm, for example via an operation panel not shown, to an operator so that the operator can adjust a position of a leading edge of the rolled transfer paper P by operating the paper automatic feeding switch 6 or the knob 9. The alarm is also given when it is judged that a rolled transfer paper is not normally conveyed based on the above-described calculation (1).

Figure 4A:
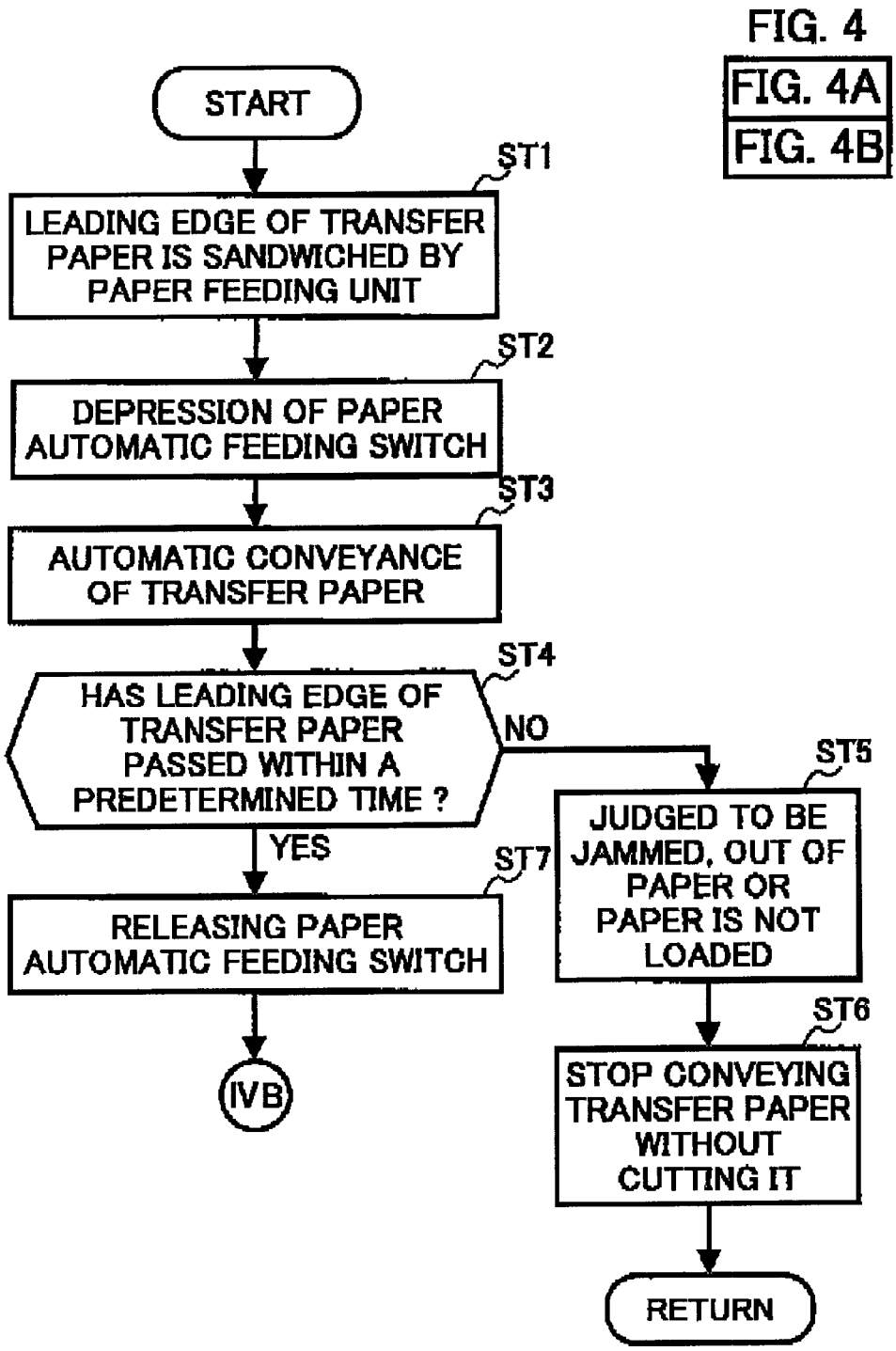
Figure 4B:
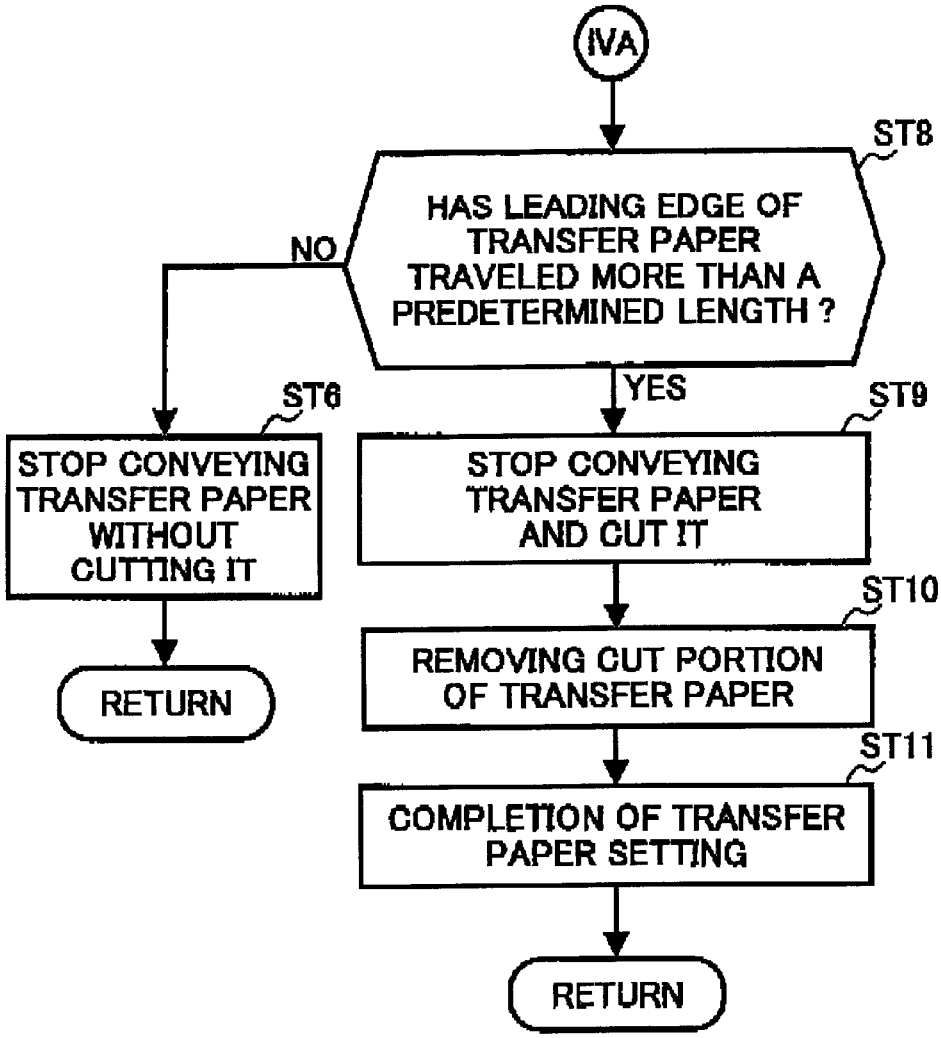

FIGS. 4, 4A and 4B are flow charts illustrating a procedure for the above-described operations. When a new rolled transfer paper P is loaded in the rolled transfer paper loading unit 2A, the rolled transfer paper P is reeled out until a leading edge thereof reaches the paper feeding roller 2B where the leading edge of the rolled transfer paper P is sandwiched by the paper feeding unit 5. The above-described operation is performed by an operator by operating the knob 9 (step ST1). When the paper automatic feeding switch 6 is depressed, the driving motor M for the paper feeding roller 2B starts to rotate. The paper feeding roller 2B then rotates in accordance with the rotation of the driving motor M to convey the sandwiched rolled transfer paper P (steps ST2 and ST3).

Because electricity is supplied to the driving motor M only during a time period when the paper automatic feeding switch 6 is depressed, the driving motor M stops the rotation when the paper automatic feeding switch 6 is released. Therefore, in a case where a finger or a part of clothes touches the paper feeding roller 2B when reeling out the rolled transfer paper P, the rotation of the paper feeding roller 2B can be stopped by releasing the paper automatic feeding switch 6 which may prevent accidents, such as when a finger or a part of clothes is wound by the paper feeding roller 2B.

During a period of time when the paper automatic feeding switch 6 is depressed, the optical sensor S1 monitors a time when a leading edge of the rolled transfer paper P passes through the optical sensor S1 (step ST4). When the time exceeds a predetermined time, it is judged that the rolled transfer paper P is jammed, the loaded rolled transfer paper P has been consumed, or the rolled transfer paper P is not loaded (step ST5). Hence, the paper cutting unit 5 does not operate (ST6). In this case, the alarming device gives an alarm to an operator.

When the paper automatic feeding switch 6 is released (step ST7), a position of a leading edge of the rolled transfer paper P is monitored (step ST8) when it is judged at the step ST4 that the rolled transfer paper P is normally conveyed. At the step ST8, it is judged whether or not the leading edge of the rolled transfer paper P has been discharged from the rolled transfer paper discharging outlet of the tray 4 by more than the predetermined length. The judgement is made based on the relational expression (2) described above. When it is judged at the step ST8 that the leading edge of the rolled transfer paper P has not been discharged from the rolled transfer paper discharging outlet of the tray 4 by more than the predetermined length, a cutting operation is not performed. The conveyance of the rolled transfer paper P is kept stopped because the paper automatic feeding switch 6 has been released. To the contrary, the paper cutting unit 5 is activated to cut a tip portion of the rolled transfer paper P (step ST9) when it is judged that the leading edge of the rolled transfer paper P has been discharged from the rolled transfer paper discharging outlet of the tray 4 by more than the predetermined length. A cut out tip portion of the rolled transfer paper P can easily be grasped and removed (step ST10).

Figure 5:
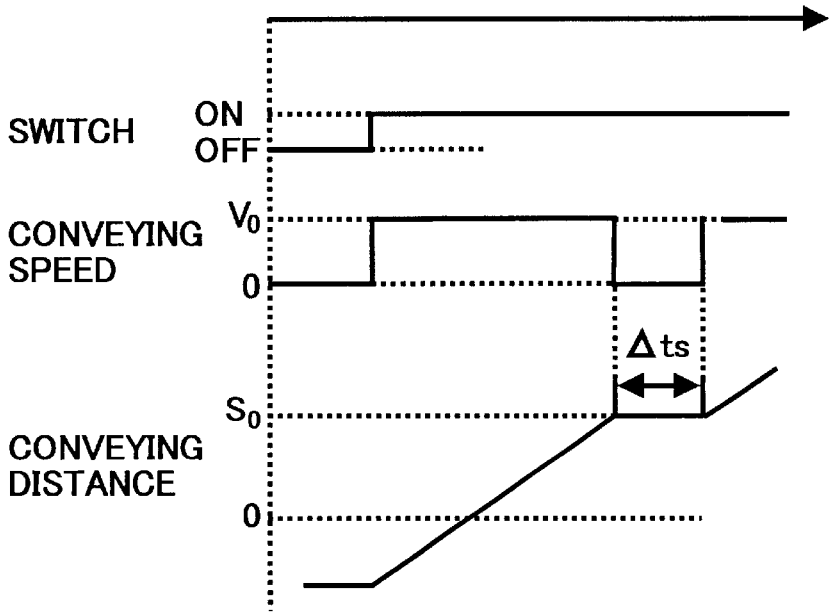
FIG. 5 is a timing diagram for illustrating a cutting operation of a tip portion of a rolled transfer paper.

FIG. 5 is a diagram illustrating processes performed at the steps ST8 and ST9 with respect to time. The reference numeral S0 indicates the length which corresponds to the predetermined length described in the relational expression (2)(i.e., L5). The predetermined length is set via an input section 8 (see FIG. 3), and the setting is adjustable. When the paper automatic feeding switch 6 is depressed, a position of a leading edge of the rolled transfer paper P is calculated from a conveying speed of the rolled transfer paper P and a period of time during which the rolled transfer paper P is conveyed after a leading edge of the rolled transfer paper P passes through the optical sensor S2. When it is judged that the leading edge of the rolled transfer paper P is discharged equal to the predetermined length through the above-described calculation, the driving motor M stops rotating even though the paper automatic feeding switch 6 is kept depressed. The rotation of the driving motor M then remains stopped for a predetermined period of time (Δts) shown in FIG. 5. When the paper automatic feeding switch 6 is released during this predetermined period of time, a tip portion of the rolled transfer paper P is cut.

If the paper automatic feeding switch is not released (i.e., the switch 6 is kept depressed), then the driving motor M starts to rotate again to convey the rolled transfer paper M after the predetermined period of time (Δts) has passed. Then, the rolled transfer paper P is conveyed until the paper automatic feeding switch 6 is released. This process can be applied not only to cut a tip portion of the rolled transfer paper P but also to cut the rolled transfer paper P into regular sizes.

When a cutting operation of a tip portion of the rolled transfer paper P has been performed, the tray 4 (or 4') is slid into the copying machine 1 (step ST11). Thus, a cut out tip portion of the rolled transfer paper P does not enter into the paper conveying path 1G, thereby preventing a paper jam caused by the cut out tip portion of the rolled transfer paper P in the paper conveying path 1G.

Figure 6:
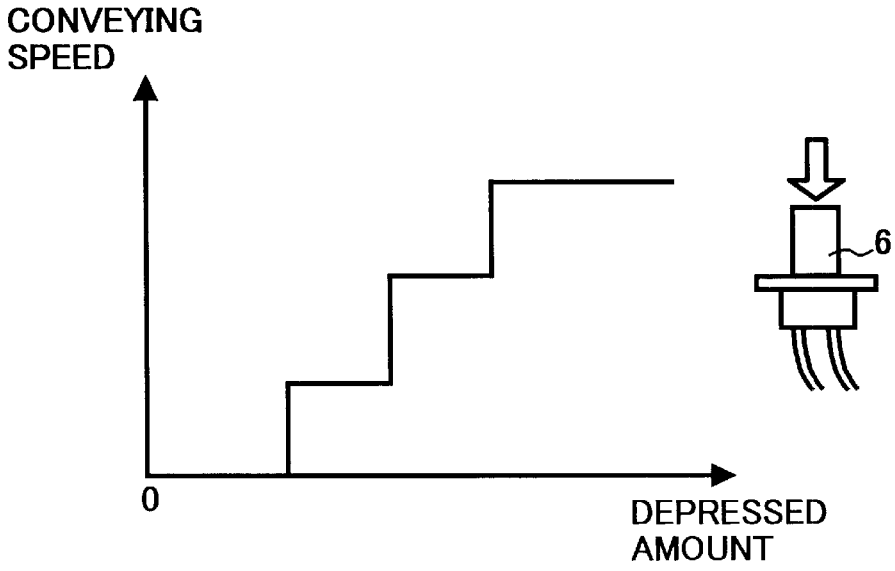
FIG. 6 is a diagram illustrating a relationship between a depressed amount of a paper automatic feeding switch and a rotational speed of a driving motor.

Referring to FIG. 6, another embodiment of the present invention is now described below. It is configured such that the rotational speed of the drive motor M changes in proportion to the depressed amount of the paper automatic feeding switch 6. That is, the further the paper automatic feeding switch 6 is depressed, the faster the speed at which the driving motor M rotates (it is mentioned as conveying speed in FIG. 6). With this configuration, a leading edge of the rolled transfer paper P can precisely be positioned with respect to the paper cutting unit 5 by adjusting a conveying speed of the rolled transfer paper P such that the rolled transfer paper P is conveyed at a low speed when an approximate position, where the rolled transfer paper P is cut, passes through the paper cutting unit 5 while it is conveyed at a fast speed when the other positions of the rolled transfer paper P pass through the paper cutting unit 5. In this case, a position of a leading edge of the rolled transfer paper is calculated by integrating an amount of change in a conveying speed of the rolled transfer paper, and then by applying it to the calculation formula described in relational expression (2).

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-120888, filed on Apr. 21, 2000 and Japanese Patent Application No. 2001-071893, filed on Mar. 14, 2001, and the entire contents thereof are herein incorporated by reference.

What is claimed as new and is desired to be secured by Letters Patent of the United States is:

1. A paper feeding unit, comprising:

a tray configured to accommodate a rolled transfer paper therein said tray including:

a paper loading unit configured to contain the rolled transfer paper;

a paper feeding device configured to feed the rolled transfer paper;

a paper cutting device configured to cut a tip portion of the rolled transfer paper fed by said paper feeding device in a transverse direction;

a paper automatic feeding switch connected to an electrical power source and configured such that said paper feeding device is driven when said paper automatic feeding switch is turned on; and a control section configured to control said paper cutting device to cut a discharged tip portion of the rolled transfer paper when said paper automatic feeding switch is turned off if the discharged tip portion has reached at least a determined length.

2. An image forming apparatus comprising the paper feeding unit recited in claim 1.

3. The paper feeding unit according to claim 1, wherein:

said tray is configured to allow replacement of the rolled transfer paper with a new rolled transfer paper by sliding said tray out of an image forming apparatus containing said tray;

said paper feeding device is configured to feed the rolled transfer paper such that a leading edge of the rolled transfer paper is discharged from a rolled transfer paper discharging outlet of said tray while said tray is slid out of the image forming apparatus; and wherein said paper cutting device is configured to cut the discharged tip portion of the rolled transfer paper such that a cut out tip portion of the rolled transfer paper is removed from said tray.

4. A paper feeding device, comprising:

a tray means for accommodating a rolled transfer paper therein said tray means including:

a paper loading means for containing the rolled transfer paper;

a paper feeding means for feeding the rolled transfer paper;

a paper cutting means for cutting a tip portion of the rolled transfer paper fed by said paper feeding means in a transverse direction;

a paper automatic feeding switch means connected to an electrical power source and configured such that said paper feeding means is driven when said paper automatic feeding switch means is turned on; and a control section configured to control said paper cutting means to cut a discharged tip portion of the rolled transfer paper when said paper automatic feeding switch means is turned off if the discharged tip portion has reached at least a determined length.

5. The paper feeding device according claim 4, wherein:

said tray means includes means for allowing for replacement of the rolled transfer paper with a new rolled transfer paper by sliding said tray means out of a main body of an image forming apparatus containing said tray means;

said paper feeding means is configured to feed the rolled transfer paper such that a leading edge of the rolled transfer paper is discharged from a rolled transfer paper discharging outlet of said tray means while said tray means is slid out of the image forming apparatus; and said paper cutting means is configured to cut a discharged tip portion of the rolled transfer paper such that a cut out tip portion of the rolled transfer paper is removed from said tray means.

6. A paper feeding unit, comprising:

a tray configured to accommodate a rolled transfer paper therein, said tray including:

a paper loading unit configured to contain the rolled transfer paper;

a paper feeding device configured to feed the rolled transfer paper;

a paper cutting device configured to cut a tip portion of the rolled transfer paper fed by said paper feeding device in a transverse direction; and a control section configured to set a discharged length of the rolled transfer paper based upon a period of time during which a paper automatic feeding switch connected to an electrical power source is turned on.

7. The paper feeding unit according to claim 6, wherein said control section is configured such that said paper feeding device is driven only when said paper automatic feeding switch is turned on, said paper feeding device being configured to stop the driving when said paper automatic feeding switch is turned off.

8. The paper feeding unit according to claim 7, wherein said paper cutting device is configured to cut a discharged tip portion of the rolled transfer paper when said paper automatic feeding switch is turned off.

9. The paper feeding unit according to claim 8, wherein said paper cutting device is configured to cut the discharged tip portion of the rolled transfer paper only when the tip portion of the rolled transfer paper has been discharged such that the discharged tip portion of the rolled transfer paper is removed.

10. A paper feeding device, comprising:

a tray means for accommodating a rolled transfer paper therein said tray means including:

a paper loading means for containing the rolled transfer paper;

a paper feeding means for feeding the rolled transfer paper;

a paper cutting means for cutting a tip portion of the rolled transfer paper fed by said paper feeding means in a transverse direction;

a detecting means for detecting a position of a leading edge of the rolled transfer paper, the detecting means being provided in a rolled transfer paper conveying path through which the rolled transfer paper is conveyed from said paper feeding means to a paper conveying path inside a main body of the image forming apparatus;

a paper automatic feeding switch means for activating said paper feeding means; and a control means connected to said detecting means and said paper automatic feeding switch means in an input side thereof, said control means connected to said paper cutting means in an output side thereof, wherein said control means for calculating a discharged length of a tip portion of the rolled transfer paper from a rolled transfer paper discharging outlet of said tray means at a time when said paper automatic feeding switch means is turned off based on a speed with which the rolled transfer paper is fed and a time when said detecting means detects the leading edge of the rolled transfer paper, the control means being configured to cause said paper feeding means to stop without activating said paper cutting means when the discharged length of the tip portion of the rolled transfer paper is not more than a predetermined length.

11. The paper feeding device according to claim 10, wherein the predetermined length corresponds to a length of the tip portion of the rolled transfer paper which can be grasped by an operator and removed when the tip portion of the rolled transfer paper is cut out.

12. The paper feeding device according to claim 10, wherein said control means is configured to stop an operation of said paper feeding means for a predetermined period of time irrespective of a switch-on operation of said paper automatic feeding switch means, when a discharging length of the tip portion of the rolled transfer paper is equal to a predetermined length.

13. The paper feeding device according to claim 10, wherein said paper automatic feeding switch means is configured to adjust a level of electricity such that electricity is supplied in multistage, a speed with which the rolled transfer paper is fed being adjusted based on the output level of electricity.

14. The paper feeding device according claim 10, wherein said tray means includes means for allowing for replacement of the rolled transfer paper with a new rolled transfer paper by sliding said tray means out of a main body of an image forming apparatus containing said tray means.

15. A paper feeding unit, comprising:

a tray configured to accommodate a rolled transfer paper therein, said tray including:

a paper loading unit configured to contain the rolled transfer paper;

a paper feeding device configured to feed the rolled transfer paper;

a paper cuffing device configured to cut a tip portion of the rolled transfer paper fed by said paper feeding device in a transverse direction;

a detecting member configured to detect a position of a leading edge of the rolled transfer paper, the detecting member being provided in a rolled transfer paper conveying path through which the rolled transfer paper is conveyed from said paper feeding device to a paper conveying path inside a main body of the image forming apparatus;

a paper automatic feeding switch configured to activate said paper feeding device; and a control section configured to connect to said detecting member and said paper automatic feeding switch in an input side thereof, said control section being connected to said paper cuffing device in an output side thereof, wherein said control section is configured to calculate a discharged length of a tip portion of the rolled transfer paper from a rolled transfer paper discharging outlet of said tray at a time when said paper automatic feeding switch is turned off based on a speed with which the rolled transfer paper is fed and a time when said detecting member detects the leading edge of the rolled transfer paper, the control section being configured to cause said paper feeding device to stop without activating said paper cuffing device when the discharged length of the tip portion of the rolled transfer paper is not more than a predetermined length.

16. The paper feeding unit according to claim 15, wherein the predetermined length corresponds to a length of the tip portion of the rolled transfer paper which can be grasped by an operator and removed when the tip portion of the rolled transfer paper is cut out.

17. The paper feeding unit according to claim 15, wherein said control section is configured to stop an operation of said paper feeding device for a predetermined period of time irrespective of a switch-on operation of said paper automatic feeding switch, when a discharging length of the tip portion of the rolled transfer paper is equal to a predetermined length.

18. The paper feeding unit according to claim 15, wherein said paper automatic feeding switch is configured to adjust a level of electricity such that electricity is supplied in multistage, a speed with which the rolled transfer paper is fed being adjusted based on the output level of electricity.

19. An image forming apparatus comprising the paper feeding unit recited in claim 15.

20. The paper feeding unit according to claim 15, wherein said tray is configured to allow for replacement of the rolled transfer paper with a new rolled transfer paper by sliding said tray out of an image forming apparatus containing said tray.

21. A paper feeding device comprising:

a tray means for accommodating a rolled transfer paper therein, said tray means including:

a paper loading means for containing the rolled transfer paper;

a paper feeding means for feeding the rolled transfer paper;

a paper cutting means for cutting a tip portion of the rolled transfer paper fed by said paper feeding means in a transverse direction; and a control section configured to set a discharged length of the rolled transfer paper based upon by a period of time during which a paper automatic feeding switch means connected to an electrical power source is turned on.

22. The paper feeding device according to claim 21, wherein said control section is configured such that said paper feeding means is driven only when said paper automatic feeding switch means is turned on, said paper feeding means being configured to stop the driving when said paper automatic feeding switch means is turned off.

23. The paper feeding device according to claim 22, wherein said paper cutting means is configured to cut a discharged tip portion of the rolled transfer paper when said paper automatic feeding switch means is turned off.

24. The paper feeding device according to claim 23, wherein said paper cutting means is configured to cut the discharged tip portion of the rolled transfer paper only when the tip portion of the rolled transfer paper has been discharged such that the discharged tip portion of the rolled transfer paper is grasped with the fingers and be removed.

* * * * *